US006839987B2

(12) United States Patent
Basso

(10) Patent No.: US 6,839,987 B2
(45) Date of Patent: Jan. 11, 2005

(54) BOOT

(75) Inventor: Fabio Basso, Asolo (IT)

(73) Assignee: Salomon S.A., Metz-Tessy (FR)

( * ) Notice: Subject to any disclaimer, the term of this patent is extended or adjusted under 35 U.S.C. 154(b) by 83 days.

(21) Appl. No.: 10/183,684

(22) Filed: Jun. 28, 2002

(65) Prior Publication Data

US 2003/0000111 A1 Jan. 2, 2003

(30) Foreign Application Priority Data

Jun. 29, 2001 (FR) ..... 01 08781

(51) Int. Cl.[7] ..... A43B 23/07; A43B 23/00; A43B 5/04

(52) U.S. Cl. ..... 36/55; 36/117.1; 36/45

(58) Field of Search ..... 36/55, 45, 99, 36/117.1, 18, 19.5, 46.5, 54

(56) References Cited

U.S. PATENT DOCUMENTS

| | | | | | |
|---|---|---|---|---|---|
| 4,899,465 | A | | 2/1990 | Bleimhofer et al. | |
| 5,285,546 | A | | 2/1994 | Haimerl | |
| 5,289,644 | A | * | 3/1994 | Driskill et al. | 36/55 |
| RE34,890 | E | * | 4/1995 | Sacre | 36/55 |
| 5,433,021 | A | * | 7/1995 | Mahler | 36/55 |
| 5,505,011 | A | * | 4/1996 | Bleimhofer | 36/55 |
| 5,678,326 | A | * | 10/1997 | Pavelescu | 36/55 |
| 5,685,091 | A | * | 11/1997 | Yalamanchili | 36/55 |
| 5,732,480 | A | | 3/1998 | Noetzold | |
| 5,802,740 | A | * | 9/1998 | Merk, Sr. | 36/55 |
| 5,992,054 | A | * | 11/1999 | Rauch | 36/30 R |
| 6,408,542 | B1 | * | 6/2002 | Shepherd | 36/54 |

FOREIGN PATENT DOCUMENTS

| | | | | |
|---|---|---|---|---|
| DE | 3840263 | | 5/1990 | |
| EP | 0286853 | A2 * | 3/1988 | A43B/7/12 |
| EP | 0544270 | | 6/1993 | |

* cited by examiner

*Primary Examiner*—Anthony Stashick
(74) *Attorney, Agent, or Firm*—Greenblum & Bernstein, P.L.C.

(57) ABSTRACT

A boot having a sole and an upper, the upper having an outer envelope whose base is fixed to the sole, in the area of the periphery of the sole. The upper of the boot has an inner envelope fixed, only by its base, to the base of the outer envelope and/or to the sole, in the area of the periphery of the sole.

21 Claims, 3 Drawing Sheets

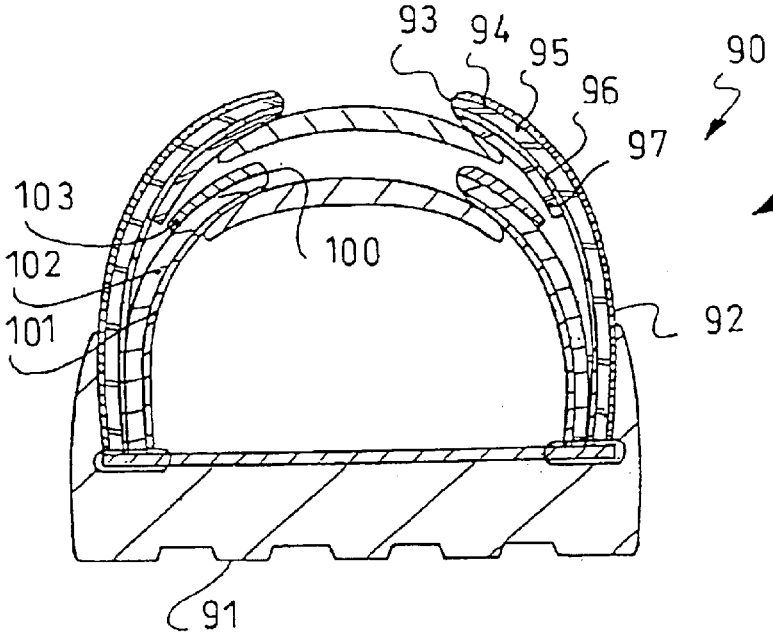
Fig. 5
Fig. 6
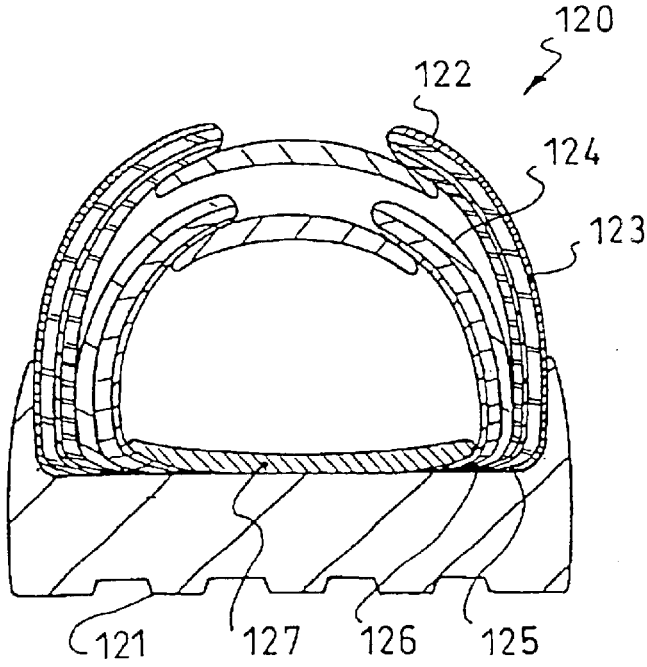

BOOT

CROSS-REFERENCE TO RELATED APPLICATION

This application is based upon French Patent Application No. 01.08781, filed Jun. 29, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a boot, especially a sports boot, and more particularly to a boot adapted to be retained on a sports apparatus.

2. Description of Background and Relevant Information

Boots of the aforementioned type can be used in fields such as snowboarding, skiing, snowshoeing, walking on ice, roller skating, skateboarding, or the like.

For certain sporting activities, it is advantageous that the boot be flexible.

For example, in snowboarding, a flexible boot makes it easy to walk or to perform certain maneuvers when operating the board.

Conventionally, there are two kinds of flexible boots for snowboarding.

The first kind is shown in FIG. 1 of the annexed drawing.

In this figure, a boot 1 has an outer portion formed of an upper 2 that overlays a walking sole 3. The upper 2, for example, has a lateral quarter 4 and a medial quarter 5, connected to one another by an insole 6. A removable liner 7 is inserted in the upper 2. It surrounds the foot and possibly a portion of the user's lower leg, and includes its own sole 8.

The liner provides comfort, for example by absorbing impacts or vibrations, or by thermally insulating the foot.

The boot 1 provided with the liner 7 has certain disadvantages. Due to its double upper, it is voluminous and cumbersome, particularly lengthwise, which sometimes causes it to overlap the board widthwise. As a result, steering is hindered by the interferences between the boot and the snow.

It is relatively heavy because it includes the outer portion and the liner.

It is expensive to manufacture for the same reason.

It partially disperses the sensorial information that is transmitted between the foot and the board, due to relative movements between the liner and the outer portion, which has a negative effect on the steering.

The second kind of boot only has a sole and an upper forming an outer portion, without a liner.

Compared to the boot 1 provided with the liner 7, the boot without liner is less cumbersome, lighter, less expensive, and does not disperse as much of the sensorial information transmitted between the foot and the board.

However, this second kind of boot has certain disadvantages.

It is not comfortable enough and does not adequately cover the foot, which hinders the steering of the board.

SUMMARY OF THE INVENTION

An object of the invention in particular is to provide a flexible boot that is compact, lightweight, economical, capable of transmitting the sensorial information, comfortable and enveloping.

The boot according to the invention has a sole and an upper, the upper having an outer envelope whose base is fixed to the sole, in the area of the periphery of the sole.

The upper of the boot according to the invention has an inner envelope fixed, only by its base, to the base of the outer envelope and/or to the sole, in the area of the periphery of the sole.

By avoiding the use of a liner, this boot is compact, lightweight, economical, and capable of transmitting the sensorial information. By having an inner envelope opposite the outer envelope, only in the area of the upper, this boot offers an adequate comfort, similar to that procured by the boots having a removable liner, and adequately covers the foot.

The boot according to the invention has the advantages of both kinds of boots from the prior art, without having the disadvantages thereof.

BRIEF DESCRIPTION OF DRAWINGS

Other characteristics and advantages of the invention will be better understood from the description that follows, with reference to the annexed drawings showing, by way of non-limiting examples, how the invention can be embodied, and in which:

FIG. 5 is a cross-section similar to FIG. 3, according to a second embodiment of the invention; and FIG. 6 is a cross-section similar to FIG. 3, according to a third embodiment of the invention.

DETAILED DESCRIPTION OF THE INVENTION

The examples that are described hereinafter relate more particularly to snowboard boots. However, the invention applies to other fields, such as those mentioned above.

The first example is described hereinafter with reference to FIGS. 2–4.

Figure 1:
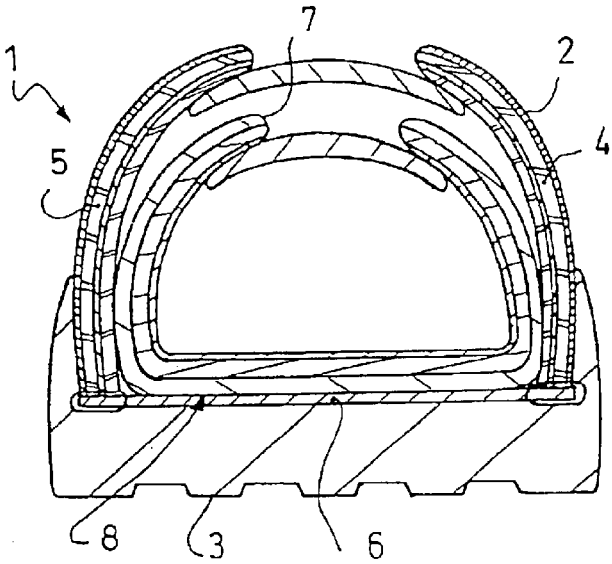
Fig. 1 Prior Art
FIG. 1 is a transverse cross-section of a boot provided with a liner according to the prior art.
Figure 2:
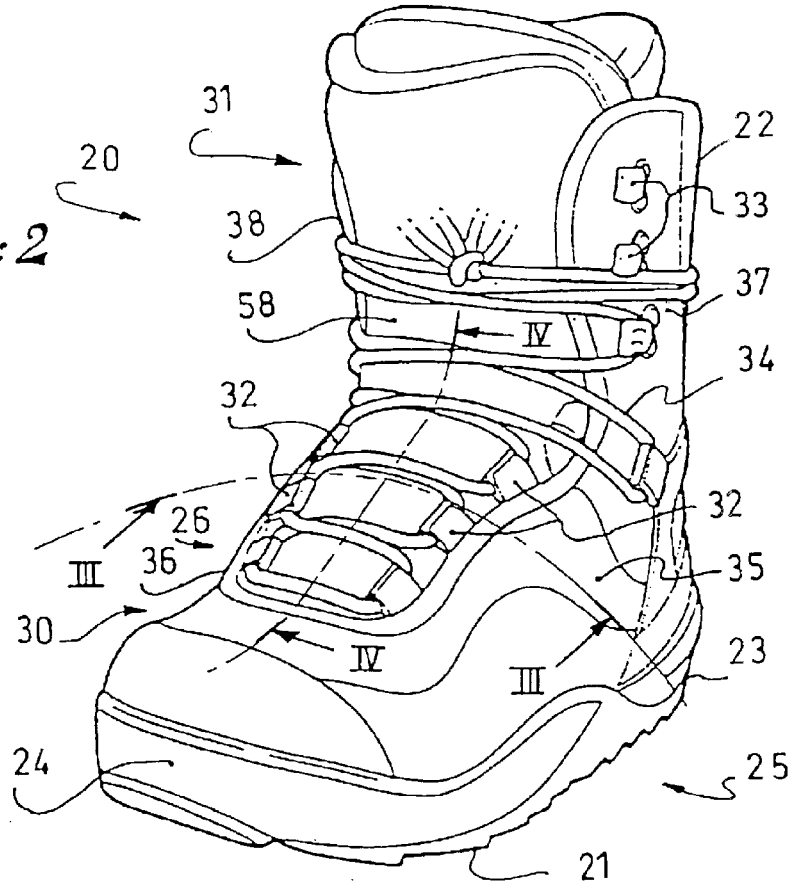
FIG. 2 is a perspective front view of a boot; according to a first embodiment of the invention.

As shown in FIG. 2, a snowboard boot 20 is provided for receiving the user's foot.

In a known manner, the boot 20 has a sole 21 and an upper 22. The boot 20 extends lengthwise between a heel 23 and a front end 24, and widthwise between a lateral side 25 and a medial side 26.

The upper 22 has a lower portion 30 provided to surround the foot, and an upper portion 31 provided to surround a portion of the lower leg.

The boot 20 is structured so as to enable a good rolling movement of the foot when walking, and leaning of the lower leg when steering a board. That is why the sole 21 and the upper 22 are relatively flexible.

However, the boot could have been provided to be more rigid to facilitate certain steering styles or certain sporting activities.

A tightening arrangement is provided to tighten the upper 22 in a reversible manner, i.e., the upper can be tightened and untightened.

The tightening arrangement has lower keepers 32 arranged on the lower portion of the upper 22, a plurality on the lateral side 25, and others on the medial side 26.

Each lower keeper 32 is shown in the form of a loop associated with the upper 22. The loop, for example, can be made with a folded flexible strap portion. A bush made of a low coefficient of friction can line the inside of the loop. Other types of keepers can be used.

The tightening arrangement also includes upper keepers 33 arranged on the upper portion of the upper 22, a plurality on the lateral side 25, others on the medial side 26.

Each upper keeper 33 is shown in the form of a hook projecting, at least partially, with respect to the upper 22. Once again, other types of keepers can be used.

The tightening arrangement further includes a lace 34 that follows a path that is determined by the keepers. For example, the lace 34 alternatively crosses a keeper located on the lateral side 25 and a keeper located on the medial side 26, both in the lower portion 30 and in the upper portion 31 of the upper 22.

It is within the scope of this invention that other paths could be envisioned for the lace 34.

In any event, a tensioning of the lace 34 allows tightening the upper 22 by bringing close together a lateral lower quarter 35 and a medial lower quarter 36 of the upper 22, and/or a lateral upper quarter 37 and a medial upper quarter 38 of the upper 22.

Other structures could be provided for the tightening arrangement, such as a series of loops controlled by levers on one side of the boot, and hooks for receiving the loops on the other side of the boot.

Figure 3:
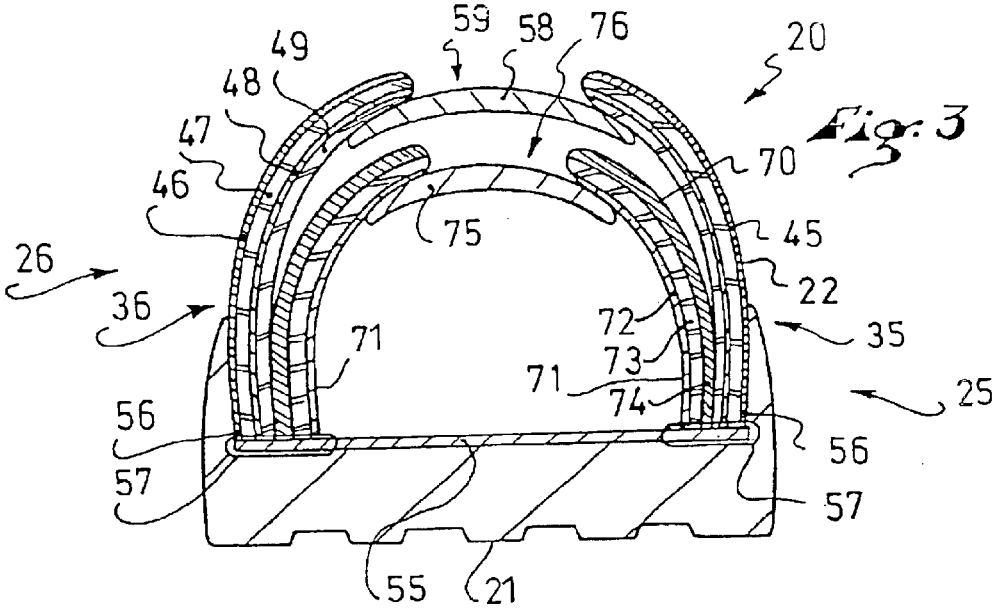
FIG. 3 is a transverse cross-section along the line III—III of FIG. 2.
Figure 4:
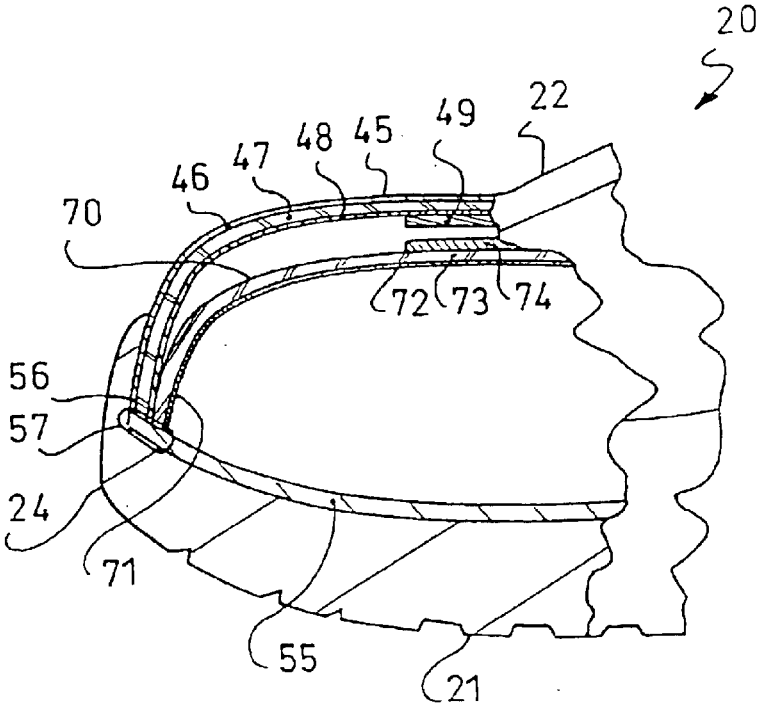
FIG. 4 is a partial longitudinal cross-section along the line IV—IV of FIG. 2.

The upper 22 has an outer envelope 45, as seen in FIGS. 3 and 4.

The keepers 32, 33 and the lace 34 of the tightening arrangement for the upper 22 are, in fact, arranged on the outer envelope 45.

The outer envelope 45 is shown in the form of a stack of layers including an outer layer 46, a core 47, an inner layer 48, and an inner lining 49.

The layers 46, 47, 48, 49 are made of materials that provide them with desired properties, such as wear resistance, watertightness, comfort, lightness, and the like. The number of layers can also vary as a function of the materials or of the desired results.

The layers 46, 47, 48, 49 are assembled to one another by means such as adhesives, stitching, or the like.

Preferably, an insole 55 is provided for maintaining the outer envelope 45 in shape before it is mounted on the sole 21.

The outer envelope 45 is affixed by its base 56 to the insole 55, by a means shown in the form of a stitching 57. Another means, such as an adhesive, could be used. However, the stitching has the advantage of being easy and quick to implement.

Furthermore, the outer envelope 45 is affixed by its base 56 to the sole 21, in the area of the periphery of the sole. Preferably, the affixation is done with an adhesive. However, another means, such as a stitching, or the combination of an adhesive and stitching, is suitable.

Complementarily, but not necessarily, a tongue 58 is provided for at least partially blocking a slit 59 of the outer envelope 45.

According to the invention, the upper 22 has an inner envelope 70 fixed, only by its base 71, to the base 56 of the outer envelope 45 and to the sole 21, in the area of the periphery of the sole 21.

The inner envelope 70 is shown in the form of a stacking of several layers including an inner layer 72, a core 73, and an outer layer 74.

Here again, the layers 72, 73, 74 are made of materials that provide them with desired properties.

The layers 72, 73, 74 are also assembled to one another by any appropriate means. Preferably, the insole 55 also maintains the inner envelope 70 in shape before it is mounted on the sole 21.

The inner envelope 70 is affixed by its base 71 to the insole 55, by a means shown in the form of a stitching. The latter is preferably the same as the stitching 57 used for the outer envelope 45. Thus, a single means maintains both the outer envelope 45 and the inner envelope 70 on the insole 55. This facilitates and speeds the manufacture.

Another means, such as an adhesive, could also be used here.

The outer envelope 45 and inner envelope 70 can be connected to one another by their respective bases 56, 71, independently of the sole 21. To this end, an affixation means, shown in the form of a stitching, is provided. The latter is preferably the same stitching 57 that affixes the outer envelope 45 and the inner envelope 70 to the insole 55.

The means for affixing the bases 71, 56 to one another can be obtained differently. For example, an adhesive could be used, or yet the combination of stitching and of an adhesive, or the like.

Given that the base 56 of the outer envelope 45 is affixed to the sole 21, and that the bases 56, 71 of the envelopes 45, 70 are affixed to one another, the base 71 of the inner envelope 70 is affixed to the sole 21.

In any event, the outer 45 and inner 70 envelopes are opposite one another, substantially above their respective bases 56, 71, without being affixed to one another above their bases. They can be in contact with one another or slightly spaced apart, as a function of the degree of tightening of the upper 21. This facilitates the tightening and loosening of the upper 2, because the envelopes 45, 70 slide with respect to one another.

Complementarily, but not necessarily, a tongue 75 at least partially blocks a slit 76 of the inner envelope 70.

Further, the arrangement for tightening the upper 2 can have keepers and a lace, or any equivalent means, arranged on the inner envelope 70.

The fact that the inner envelope 70 is housed in the outer envelope 45 provides the upper 22 with a comfort that can be compared to that obtained with a liner. The fact that the inner envelope 70 is fixed by its base 71 to the base 56 of the outer envelope 45 and to the sole 21 provides the boot 20 with an ability to transmit the sensorial information. Indeed, the base 71 is in a fixed position with respect to the sole 21, on the one hand, and the foot is in a more direct contact with the sole 21, on the other hand.

The fact that the layers 72, 74, and the core 73 of the inner envelope 70 do not extend across the boot 20, to pass between the foot and the sole 21, makes it possible to reduce the vertical space requirement of the boot 20, as well as its weight. The saving in weight can be as much as about 15%.

Furthermore, both the inner envelope 70 and the outer envelope 56 have a common reference, namely the insole 55. Therefore, there is no loss or dispersion of the forces transmitted by the gliding apparatus to which the boot is attached.

As seen in FIG. 4, the inner lining 49 of the outer envelope 45 as well as the outer layer 74 of the inner envelope 70 do not extend up to the front end 24 of the boot 20. Thus, the outer 45 and inner 70 envelopes have a reduced thickness in the area of the front end 24.

Similarly, although this is not shown, the outer 45 and inner 70 envelopes have a reduced thickness in the area of the heel 23.

This manufacturing technique makes it possible to reduce the longitudinal space requirement of the boot.

Indeed, for a given internal volume, the outer length of the boot according to the invention is reduced by one or two sizes compared to a boot having the same internal volume according to the prior art.

This architecture does not cause any hindrance for the user, for the forces exerted on the upper in steering a snowboard are oriented substantially laterally.

As a result, the boot according to the invention does not overlap a snowboard widthwise as much, or at all.

The other examples of embodiment of the invention are shown hereinafter by means of FIGS. 5 and 6.

For reasons of convenience, only the differences with respect to the first example are shown.

According to the second example, as seen in FIG. 5, a boot 90 includes a sole 91 and an upper 92. An outer envelope 93 of the upper 92 is formed of a stack including an outer layer 94, a core 95, an inner layer 96, and an inner lining 97.

An inner envelope 100 of the upper 92 is formed of a stack including an inner layer 101, a core 102, and an outer layer 103.

Along the transverse direction of the boot 90, the outer 93 and inner 100 envelopes have a reduced thickness in the vicinity of and in the area of the sole 91. The inner lining 97 of the outer envelope 93, as well as the outer layer 103 of the inner envelope 100, do not extend down to the sole 91.

This manufacturing technique makes it possible to reduce the transverse space requirement of the boot 90.

According to the third example, as seen in FIG. 6, a boot 120 has a sole 121 and an upper 122. An outer envelope 123 and an inner envelope 124 of the upper 122 each has a certain number of layers. Each envelope 123, 124 has a base 125, 126, respectively.

Before the affixation of the upper 122 to the sole 121, an insole 127 is affixed to the bases 125, 126 by an adhesive means, or by an equivalent means. The insole 127 maintains the upper 122 in shape, and the bases 125, 126 folded.

The assembly, formed by the envelopes 123, 124 and the insole 127, is then affixed to the sole 121 by an adhesive, or by an equivalent means.

In any event, the invention is made from materials and according to techniques known to a person with ordinary skill in the art.

The invention is not limited to the particular examples described hereinabove, and includes all of the technical equivalents that fall within the scope of the claims that follow.

In particular, the number and the thickness of the layers constituting the outer and inner envelopes of the upper can vary. The structure of the upper could include, for at least one of the envelopes, a quarter that overlaps the other.

What is claimed is:

1. A boot comprising:

a sole having a peripheral area;

an upper comprising:

an outer envelope having a base, the base of the outer envelope being fixed to the sole in an area of the periphery of the sole;

an inner envelope having a base, the inner envelope being only fixed in position relative to the outer envelope by means of the base of the inner envelope being fixed to at least one of the following:

the base of the outer envelope;

the peripheral area of the sole.

2. A boot according to claim 1, further comprising: an insole;

the base of the outer envelope and the base of the inner envelope are fixed directly to the insole.

3. A boot according to claim 1, wherein:

the outer envelope is fixed to the sole by means including glue.

4. A boot according to claim 1, wherein:

the inner envelope is affixed to the outer envelope by means including stitching.

5. A boot according to claim 1, further comprising: an insole;

the base of the outer envelope and the base of the inner envelope are folded at respective lower ends of the outer and inner envelopes, respectively, and are maintained folded by means of the insole.

6. A boot according to claim 1, wherein:

the outer envelope and the inner envelope are each made in the form of a stack of several layers.

7. A boot according to claim 1, wherein:

at least one of the following has a reduced thickness:

the outer envelope in a front end area of the outer envelope;

the outer envelope in a heel area of the outer envelope;

the outer envelope in an area of the sole;

the inner envelope in a front end area of the inner envelope;

the inner envelope in a heel area of the inner envelope;

the inner envelope in an area of the sole.

8. A boot according to claim 1, further comprising:

a lower portion adapted to house a foot of a wearer; and an upper portion adapted to house a portion of a lower leg of the wearer.

9. A boot according to claim 1, further comprising:

a longitudinally extending slit in the outer envelope;

a tongue at least partially blocking the slit of the outer envelope;

a longitudinally extending slit in the inner envelope;

a tongue at least partially blocking the slit of the inner envelope.

10. A boot according to claim 1, further comprising:

a tightening arrangement provided to tighten the upper and to untighten the upper, selectively, on the foot of the wearer.

11. A boot according to claim 10, wherein:

the tightening arrangement comprises a lace and a plurality of lace keepers fixed to the outer envelope on each of opposite sides of a slit in the outer envelope.

12. A boot according to claim 1, further comprising:

an insole having an upper surface exposed to an inner volume of the boot, the upper surface being adapted to support directly a foot of the wearer.

13. A boot according to claim 1, further comprising:

an insole;

a lower end of the base of the outer envelope and a lower end of the base of the inner envelope are fixed in place beneath the insole.

14. A boot according to claim 1, further comprising:

an insole;

a lower end of the base of the outer envelope and a lower end of the base of the inner envelope are fixed in place above the insole.

15. A boot comprising:

a sole having a peripheral area;

an upper comprising:

an outer envelope having a base, the base of the outer envelope being fixed to the sole in an area of the periphery of the sole;

an inner envelope having a base, the inner envelope being fixed in position relative to the outer envelope by means of the base of the inner envelope being fixed to at least one of the following:

the base of the outer envelope;

the peripheral area of the sole;

the inner envelope having an upper portion above the base of the inner envelope, the upper portion extending from a medial side to a lateral side of the upper;

the upper portion of the inner envelope not being connected to the outer envelope above the base of the outer envelope.

16. A boot according to claim 15, further comprising:

an insole;

the base of the outer envelope and the base of the inner envelope are fixed directly to the insole.

17. A boot according to claim 15, the boot being a snowboard boot and wherein:

the outer envelope comprises:

a lower portion adapted to house a foot of a wearer; and a flexible upper portion adapted to house a portion of a lower leg of the wearer, the flexible upper portion adapted to flex relative to the lower portion during use of the boot by the wearer.

18. A snowboard boot comprising:

an external sole;

an upper comprising:

a flexible outer envelope having a base, said base of said outer envelope comprising a lower end extending at least along a medial side of said upper and a lower end extending at least along a lateral side of said upper;

a flexible inner envelope positioned within said outer envelope, said inner envelope having a base, said base of said inner envelope comprising a lower end extending at least along said medial side of said upper and a lower end extending at least along said lateral side of said upper;

an insole;

said lower ends of said medial and lateral sides of said inner envelope being positioned above said insole; and said inner envelope further comprising an upper portion above said base of said inner envelope, said upper portion of said inner envelope not being connected to said outer envelope above said base of said outer envelope and said inner envelope being free to slide relative to said outer envelope upon flexing of the flexible outer envelope during use of the boot by a wearer.

19. A snowboard boot according to claim 18, wherein:

said base of said inner envelope is fixed to said insole at least by one of the following: stitching and glue.

20. A snowboard boot comprising:

an external sole;

an upper comprising:

a flexible outer envelope having a base, said base of said outer envelope comprising a lower end extending at least along a medial side of said upper and a lower end extending at least along a lateral side of said upper;

a flexible inner envelope positioned within said outer envelope, said inner envelope having a base, said base of said inner envelope comprising a lower end extending at least along said medial side of said upper and a lower end extending at least along said lateral side of said upper;

an insole;

said lower ends of said medial and lateral sides of said inner envelope being positioned beneath said insole; and said inner envelope further comprising an upper portion above said base of said inner envelope, said upper portion of said inner envelope not being connected to said outer envelope above said base of said outer envelope and said inner envelope being free to slide relative to said outer envelope upon flexing of the flexible outer envelope during use of the boot by a wearer.

21. A snowboard boot according to claim 20, wherein:

said base of said inner envelope is fixed to said insole at least by one of the following: stitching and glue.

* * * * *